US011890529B2

(12) United States Patent
Chavand

(10) Patent No.: US 11,890,529 B2
(45) Date of Patent: Feb. 6, 2024

(54) INDIVIDUAL MOVEMENT EQUIPMENT CONSTITUTED BY A PAIR OF MOTORIZED SKATES

(71) Applicant: ROLLKERS, Iguerande (FR)

(72) Inventor: Paul Chavand, Iguerande (FR)

(73) Assignee: ROLLKERS, Iguerande (FR)

( * ) Notice: Subject to any disclaimer, the term of this patent is extended or adjusted under 35 U.S.C. 154(b) by 0 days.

(21) Appl. No.: 17/596,253

(22) PCT Filed: Jun. 5, 2020

(86) PCT No.: PCT/FR2020/050965

§ 371 (c)(1),
(2) Date: Jan. 6, 2022

(87) PCT Pub. No.: WO2020/245550

PCT Pub. Date: Dec. 10, 2020

(65) Prior Publication Data

US 2022/0314102 A1 Oct. 6, 2022

(30) Foreign Application Priority Data

Jun. 5, 2019 (FR) ..... 1905971

(51) Int. Cl.
*A63C 17/00* (2006.01)
*A63C 17/06* (2006.01)
*A63C 17/12* (2006.01)

(52) U.S. Cl.
CPC ..... *A63C 17/0073* (2013.01); *A63C 17/062* (2013.01); *A63C 17/065* (2013.01); *A63C 17/12* (2013.01)

(58) Field of Classification Search
CPC ... A63C 17/12; A63C 17/0073; A63C 17/062; A63C 17/065
See application file for complete search history.

(56) References Cited

U.S. PATENT DOCUMENTS 4,382,605 A * 5/1983 Hegna ..... A63C 17/062 280/11.225
9,925,453 B1 * 3/2018 Tuli ..... A43C 19/00
(Continued)

FOREIGN PATENT DOCUMENTS

EP 2531264 B1 9/2016
WO 95/35136 12/1995
(Continued)

OTHER PUBLICATIONS

International Search Report for International Application No. PCT/FR2020/050965 dated Oct. 16, 2020, 2 pages.
(Continued)

*Primary Examiner* — Brian L Swenson
(74) *Attorney, Agent, or Firm* — TraskBritt

(57) ABSTRACT

An individual movement equipment item, which is constituted by a pair of motorized skates, each of the motorized skates comprising: a plate in the form of a sole and having a front portion, which is articulated transversely relative to a rear portion, the plate having means for connecting to the foot or the shoe of the user, motorized means, which are formed by two portions, which are articulated transversely in order to form a front train and a rear train, connection means between the articulated plate and the motorized means, which connect the front portion to the front train and the rear portion to the rear train, characterized in that the angle of the longitudinal axis of the at least one of the trains of each of the skates forms an angle between 10° and 20°, and preferably of from 12° to 15°, with the longitudinal axis of the plate.

17 Claims, 2 Drawing Sheets

(56) References Cited

U.S. PATENT DOCUMENTS

| | | | | |
|---|---|---|---|---|
| 2017/0259162 | A1* | 9/2017 | Mo | A63C 17/12 |
| 2019/0314710 | A1* | 10/2019 | Zhang | A63C 17/04 |
| 2021/0113914 | A1* | 4/2021 | Zhang | G05D 1/0223 |
| 2022/0118345 | A1* | 4/2022 | Zhang | A63C 17/12 |

FOREIGN PATENT DOCUMENTS

| | | | |
|---|---|---|---|
| WO | 2018/082195 | A1 | 5/2018 |
| WO | 2018/090135 | A1 | 9/2018 |

OTHER PUBLICATIONS

International Written Opinion for International Application No. PCT/FR2020/050965 dated Oct. 16, 2020, 11 pages with machine translation.

* cited by examiner

INDIVIDUAL MOVEMENT EQUIPMENT CONSTITUTED BY A PAIR OF MOTORIZED SKATES

CROSS-REFERENCE TO RELATED APPLICATIONS

This application is a national phase entry under 35 U.S.C. § 371 of International Patent Application PCT/FR2020/050965, filed Jun. 5, 2020, designating the United States of America and published as International Patent Publication WO 2020/245550 A1 on Dec. 10, 2020, which claims the benefit under Article 8 of the Patent Cooperation Treaty to French Patent Application Serial No. 1905971, filed Jun. 5, 2019.

TECHNICAL FIELD

The present disclosure is in the field of urban mobility, and relates to an individual movement means making it possible to walk at a speed faster than that of normal walking, without any skating movement, without backswing stroke, and without modifying the rhythm, amplitude or longitudinal stability of natural walking.

BACKGROUND

This motorized movement means constitutes a new solution for individual mobility, in a relatively urban environment, which achieves an advantageous combination of walking and the moving walkway, and which could be defined as a sort of "integrated and progressive treadmill" that takes place under the walker's shoes. The present disclosure thus has more advantages than all the means of individual urban mobility currently in existence, in particular, including speed, safety, comfort of use, very small personal footprint and immediate mastery without learning.

Patent application WO2018090135 is known in the state of the art describing an individual movement equipment item intended to transport a person by wearing a pair of power-assisted motorized shoes, used in a normal forward walking action that provides a supplementary walking speed adjusted based on a user's intended walking speed; even the intended speed changes during an intermediate step. The sole of each of the shoes houses a relatively stiff plate coupled with tracks in the toe and heel sections, respectively, which are connected by a relatively flexible portion. The assembly is designed to neutralize forces that disrupt its operation during walking while the flexible portion assists in bending the shoe naturally to maintain the natural walking balance and movement. In addition, the flexible portion may be fitted with ribs or hinges for easier bending than twisting. The relatively stiff front and rear plates can be made of twistable and bendable materials, but to a lesser extent than the flexible portion.

International patent application WO1995035136 is also known, describing another example of a skate with a single row of rollers to be worn on a sports or all-terrain shoe comprising at least two rollers mounted in a frame. The skater's shoe may be attached to a sole support plate secured to the frame. In order to align the rollers, the frame can pivot about an axis (A) substantially perpendicular to the sole support plate and be secured in position with the sole support plate.

The solution proposed by patent application WO2018090135 is based on the use of a pair of front tracks and a pair of rear tracks, all the tracks being parallel to one another, and aligned in pairs. This results in hyperstatic behavior that is not natural for a walking movement where the foot is not oriented strictly along the axis perpendicular to the median plane. This results in a component of transverse forces resulting in a loss of energy.

Patent application WO1995035136A1 relates not to motorized equipment, but to a single-track roller skate of the "roller" type. The problem is not the same as that of a motorized skate. The goal of this non-motorized single-track skate is to improve the power transmitted by the supporting foot during a "skating" movement.

BRIEF SUMMARY

In order to remedy these drawbacks, the present disclosure relates in its most general sense to an individual movement equipment item constituted by a pair of motorized skates, each of the motorized skates being constituted by:

- a plate in the form of a sole and having a front portion that is articulated transversely relative to a rear portion, the plate having means for connecting to the foot or the shoe of the user,
- motorized means that are formed by at least two portions that are articulated transversely in order to form a front rolling train and a rear rolling train,
- connection means between the articulated plate and the motorized means that connect the front portion to the front train and the rear portion to the rear train characterized in that the angle of the longitudinal axis of at least one of the trains of each of the skates forms an angle between 5° and 20°, and preferably 12° to 15°, with the longitudinal axis of the plate.

This angle is either fixed or adjustable to allow adaptation to each user, in particular to take account of the value of his valgus.

According to particular variants, for each of the skates:

- the longitudinal axis of the front train and the longitudinal axis of the rear train are parallel,
- the longitudinal axis of the front train and the longitudinal axis of the rear train are laterally offset,
- the driving of the front train and the rear train is carried out by a single motor,
- the driving of the front train and the rear train is carried out by an electric rotor motor,
- the electric motor can advantageously be coupled to a flywheel,
- the axis of the motor corresponds to the transverse articulation axis of the trains;
- the front and rear trains are fitted with tracks,
- the front and rear trains are fitted with wheels,
- the transverse articulation axis of the plate has a direction different from that of the transverse articulation axis of the front train relative to the rear train.
- the rear train is connected to an intermediate portion of the rear portion of the plate.

BRIEF DESCRIPTION OF THE DRAWINGS

The present disclosure will be better understood on reading the following description, in reference to non-limiting embodiments illustrated by the accompanying drawings, in which.

DETAILED DESCRIPTION

Figure 1:
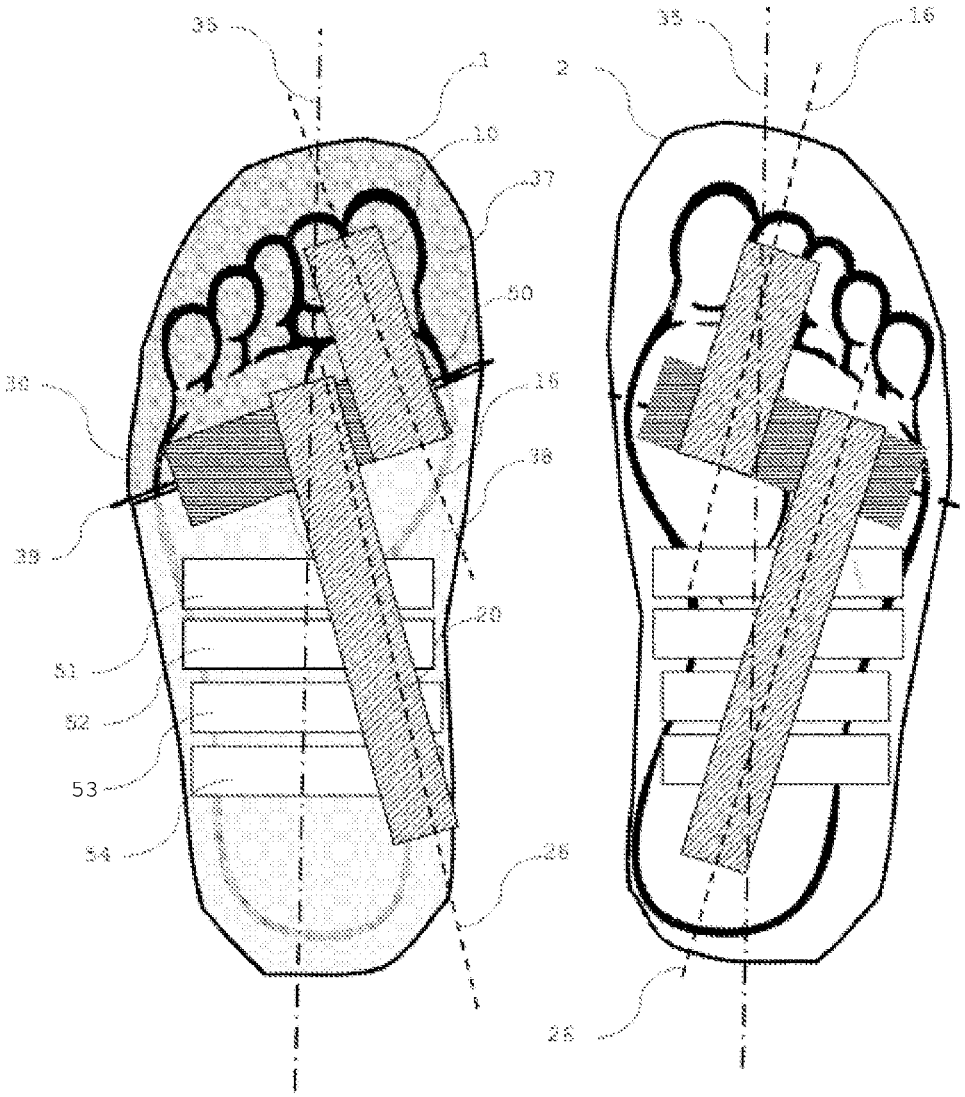
FIG. 1 shows a schematic bottom view of an equipment item according to the present disclosure.

FIG. 1 shows a very schematic view of the mobility equipment item formed by a pair of motorized skates (1, 2) seen from below, the soles of the feet being shown to facilitate understanding of the operation and not forming part of the present disclosure.

Each skate is formed by a rigid plate (30) having the general shape of a sole supporting a front mobile train (10) and a rear mobile train (20). This plate is formed by two portions that are articulated along a transverse axis (39), the front portion (37) corresponding substantially to the toes, and the rear portion (38) corresponding to the sole and the heel. The front (10) and rear (20) trains are powered by a common motor (50) inside the roller common to the front and rear trains, for example, an electric motor with an outer rotor, driving tracks. This motor can be fitted with a reduction gear, for example, in the form of an epicyclic gear, and a stepping actuator controlled as a function of commands transmitted by the user.

The rear train (20) also has a housing for receiving electric batteries (51 to 54).

The longitudinal axis (16) of the front train (10) forms an angle of approximately 15° with the longitudinal axis (35) of the plate (30). The longitudinal axis (26) of the rear train (20) forms an angle of approximately 15° with the longitudinal axis (35) of the plate (30). These two longitudinal axes (16, 35) are laterally offset with respect to one another.

These angles can be adjustable to suit the user's valgus, for example, between 10 and 20°.

Example Embodiment

Figure 2:
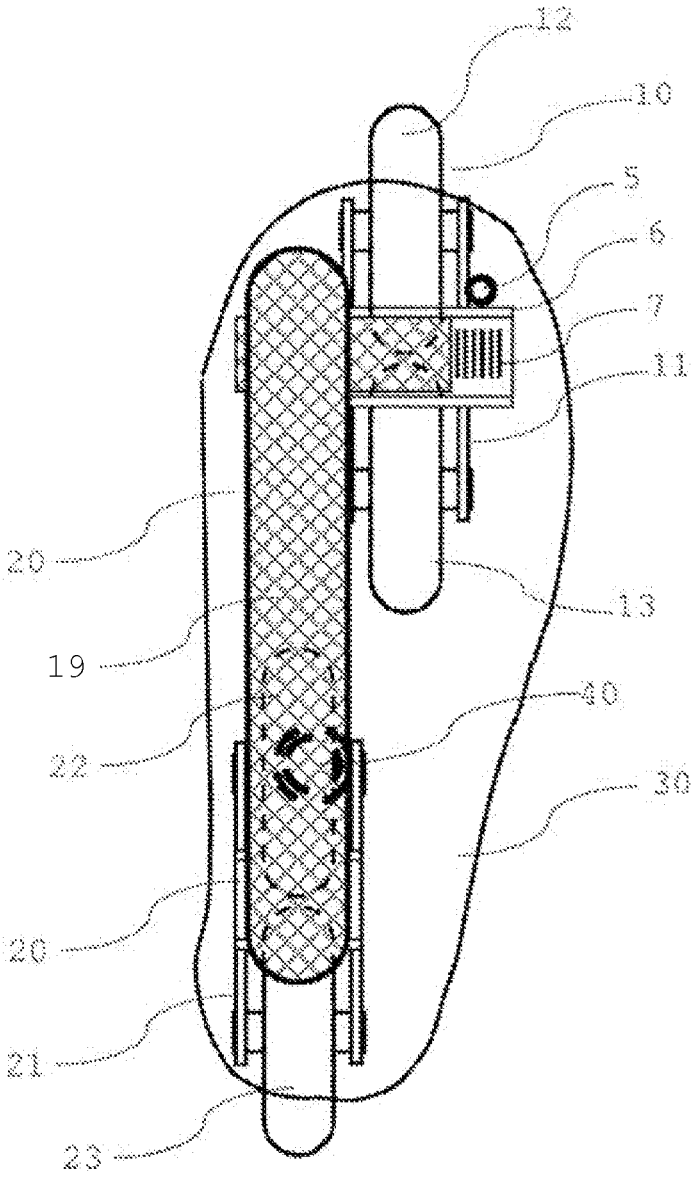
FIG. 2 shows a bottom view of a first embodiment.

FIG. 2 corresponds to a first embodiment of a skate. The locomotion equipment item consists of a pair of skates comprising rolling or sliding trains (10, 20) connected to a sole (30) that attaches to the feet either in the form of special shoes or as additional skates attached under the shoes.

Each skate (1, 2) is composed of a frame (19) equipped with mobile trains (10, 11; 20, 21), that is to say, trains rolling (12, 13, 22, 23) or sliding on the ground, each mobile train being a secured assembly of wheels, tracks or sliding segments, all these mobile trains having the same direction of movement, that is to say, of rolling or sliding, and of a plate, specific in the case of a sole (30) fixed under the shoes, or constituted by the sole (30) in the case of a special shoe.

For each skate, the plate (30) is mounted with an orientation, in its own plane, that is oblique with respect to the direction of movement of the mobile trains (10, 20). Advantageously, the plate (30) can be mounted at a point of the frame on a rotation means (40), pivot or swivel system, allowing this orientation to be preset.

The oblique orientation of the plate can create overhangs of the foot with respect to the support points of the rolling or sliding trains, which can cause lateral instability of the skates if the width of the support polygon defined by the position of the rolling or sliding trains is insufficient.

In order to reduce the width of the support polygon while compensating for the overhang of the support points of the feet, the present disclosure is based on the lateral offset of the rolling or sliding trains with respect to one another. This offset allows the rolling or sliding trains to be positioned along the longitudinal axis of the plate (30) to support the support points of the foot, while letting them roll or slide in the direction of movement, that is to say, obliquely with respect to the longitudinal axis. Consequently, the width of the plate can be reduced to that of the support polygon.

However, when the plate of the skate that is the object of this present disclosure is oriented obliquely, a diagonal inclination of the supporting leg, for example, during the skating thrust, risks causing the rolling or sliding trains furthest to the outside of the feet to leave the ground. To counter this effect and to keep all the mobile trains on the ground, the pivot can advantageously be made of an elastic material of suitable stiffness, allowing the plate that tilts with the foot along its roll axis to deform the pivot such that the frame and its mobile trains remain flat and parallel to the ground.

In the case where it is necessary to obtain a significant orientation of the plate with respect to the rolling or sliding direction of the rolling trains, it may be advantageous to make this orientation, as well as the offset of the rolling or sliding trains relative to one another, configurable.

This configurable orientation of the plate relative to the direction of movement of the mobile trains can be obtained by a rotation or swivel means (40), allowing the orientation of the plate to be pre-adjusted relative to the frame, and able to be coupled to a locking device (7) allowing the rolling direction to be locked during the use of the skates.

In order to prevent the foot from overhanging the support polygon of the mobile trains, it may be necessary to add a pre-adjustment mechanism for the lateral positioning of certain mobile trains so that the offset of the mobile trains optimizes the support polygon in relation to the support points of the foot on the plate.

In this case, it is advantageously possible to produce an articulated mechanism providing coupling between a point of the plate (30) and each lateral positioning mechanism.

This mechanism can be an articulated parallelogram, preserving the parallelism of the rolling or sliding trains, and coupled by a pivot at a point on the plate.

It is also possible to use spacing-tightening cams actuated by the rotation of the plate on its pivot, with, if necessary, transmission rods toward the rolling or sliding trains to be offset.

Finally, it is advantageously possible to use slides, which keep the mobile trains on the frame while allowing them to slide laterally, each being coupled to the articulated attachment point of the plate.

Each shiftable mobile train can then be locked owing to this coupling if the orientation of the plate is itself locked.

When certain rolling trains are tracks having a common roller, their lateral offset is necessarily greater than the track width, since the tracks cannot overlap. In the case where the lateral offset is made configurable, the common roller can advantageously be composed of an internal support cylinder, around which the external cylinders acting as pulleys are mounted, at least one of them being free to slide sideways along the internal cylinder when adjusting.

A first particular embodiment of the present disclosure is an in-line roller skate composed of a sole (30) equipped with two rolling mobile trains (10, 20), each comprising two in-line wheels (12, 13; 22, 23), and a plate mounted on the frame by a pivot (40) allowing its orientation to be pre-adjusted obliquely with respect to the rolling direction of the rolling trains (FIG. 2).

The pivot (40) is made of an elastic material of the polymer type, the stiffness of which is sufficient to keep the plate stable in the normal position (excluding thrust force), but allowing it to tilt in roll with the foot when pushing on the skate, so that the four wheels remain flat on the ground when the foot is pushed if the two rolling trains are offset.

In this embodiment, only the front rolling train can be offset relative to the rear rolling train, which remains secured to the frame.

The offset mechanism is a rail slide (6), secured to the front rolling train, and sliding laterally along a rail fixed to the frame.

The coupling of the plate to the lateral offset slide (6) of the front rolling train is obtained by a fork (5) secured to the front of the plate, and acting laterally on the offset slide (6).

The rail secured to the frame incorporates a spring pressing it against the slide (6), the two facing surfaces being notched so as to obtain locking under all conditions (free or shod skate). The offset is pre-adjusted manually, by temporarily moving the front rolling train away from the plate, which neutralizes the compression force of the spring, and by adjusting the lateral offset. The locking occurs immediately after releasing the separation force, and is reinforced by the weight of the skater when he puts his foot on the ground.

Alternative with Track

A second particular embodiment of the present disclosure is a skate with two tracks (FIG. 1), composed of a frame equipped with two mobile rolling trains (10, 20), each consisting of a track with two end rollers, the tracks rolling in the same direction. The plate (30) supporting the shoe is mounted on a pivot allowing its orientation to be pre-adjusted, in its own plane, obliquely with respect to the rolling direction of the rolling trains along the longitudinal axis (16, 26).

Only the front rolling train can be offset relative to the rear rolling train, which remains secured to the frame.

The offset and locking mechanism of the front rolling train, as well as its coupling means to the plate, are identical to those of the roller skate constituting the first particular embodiment.

A variant of this second particular embodiment may be provided by combining the rear roller of the front track and the front roller of the rear track (39).

This variant is particularly advantageous since the common roller, which is at least twice as long as the others, is ideally located at the metatarsal joint, that is to say, at the widest point of the foot.

Variant Embodiments

Various variant embodiments are possible.

The pair of rolling or sliding skates for attachment to the feet can be made in the form of special shoes, or as additional skates attached under the shoes, each skate being composed of a frame equipped with several mobile trains, all rolling or sliding in the same direction, and of a plate, specific in the case of an additional skate or constituted by the sole in the case of a special shoe, characterized in that the plate is mounted obliquely with respect to the direction of movement of the mobile trains, and that at least one of the mobile trains is offset laterally with respect to the others so that all of the mobile trains support the support points of the foot while allowing the width of the skate to be kept close to that of the foot.

At Least One Wheeled Train

According to a first variant, the pair of skates comprises, for at least one of its mobile trains (10, 20), a fixed assembly of wheels rolling in the same direction, at least one of which, for each train, is driven by the motor (50). Alternatively, each train (10, 20) has a driving wheel.

At Least One Train with Tracks

According to a second variant, the pair of skates comprises a track for at least one of the mobile trains (10, 20).

At Least One Sliding Train

According to a third variant, at least one of the mobile trains (10, 20) is composed of segments that can slide on the ground.

Rolling without Leaving the Ground

According to another variant, the means for connecting the plate (30) with the mobile trains (10, 20) are made of elastic material allowing the plate (30) to be tilted in roll without all or some of the mobile trains leaving the ground.

Orientation Adjustable/Lockable by Rotation System

According to another variant, the plate (30) is mounted on the frame by rotation means allowing the orientation of the plate to be pre-adjusted relative to the direction of movement of the mobile trains (10, 20), the rotation means being coupled to a locking device allowing the rolling direction to be locked during the use of the skates.

Locking by Notching

According to another variant, a device for locking the orientation of the plate is obtained by notching the faces of the elements that face one another, held by an elastic system when the skate is not on the ground, wherein the elastic system allows the pre-adjustment to be changed by hand and is arranged so that the user's weight on the skate reinforces the locking effect.

Offset Coupled with Orientation

According to another variant, each mobile train (10, 20) can be offset and comprises a coupling means with the orientation of the plate (30) so that the offset of the mobile trains optimizes the support polygon with respect to the support points of the foot on the plate.

Coupling by Articulated Link

According to yet another variant, for each skate, the means for coupling the plate (30) to the lateral offset mechanism of a mobile train (10, 20) is a mechanical link articulated between the plate and the offset mechanism.

Slide Offset

According to another variant, for each skate, the lateral offset mechanism of a rolling train (10, 20) is a slide (6), which keeps the rolling train on the frame while allowing it to slide laterally under the action of the articulated link.

Shoe Integration

According to a particular embodiment, each of the skates is completely integrated into a shoe.

The invention claimed is:

1. A pair of motorized skates, each of the motorized skates comprising:

an articulated plate in the form of a sole and having a front portion articulated transversely relative to a rear portion, the plate having means for connecting to a foot or a shoe of a user; and a motorized mechanism including two portions that are articulated transversely relative to one another, the motorized mechanism including a front train and a rear train;

wherein the articulated plate is connected to the motorized mechanism, the front portion connected to the front train and the rear portion connected to the rear train;

wherein an angle between a longitudinal axis of at least one of the trains of each of the skates and a longitudinal axis of the articulated plate of the respective skate is between 10° and 20°; and wherein, for each of the skates, a longitudinal axis of the front train and a longitudinal axis of the rear train are parallel.

2. The pair of motorized skates according to claim 1, wherein, for each of the skates, the longitudinal axis of the front train and the longitudinal axis of the rear train are laterally offset from one another.

3. The pair of motorized skates according to claim 2, wherein each of the skates further comprises a single motor configured to drive both the front train and the rear train of the respective skate.

4. The pair of motorized skates according to claim 3, wherein the single motor of each of the skates has an external rotor.

5. The pair of motorized skates according to claim 4, wherein, for each of the skates, an axis of the motor is also a transverse articulation axis of the front train and the rear train of the respective skate.

6. The pair of motorized skates according to claim 5, wherein the front and rear trains of each of the skates are fitted with tracks.

7. The pair of motorized skates according to claim 5, wherein the front and rear trains of each of the skates are fitted with wheels.

8. The pair of motorized skates according to claim 5, wherein, for each of the skates, the transverse articulation axis of the plate has a direction different from that of a transverse articulation axis of the front train relative to the rear train.

9. The pair of motorized skates according to claim 5, wherein, for each of the skates, the rear train is connected to an intermediate portion of the rear portion of the plate.

10. The pair of motorized skates according to claim 1, wherein the angle between a longitudinal axis of at least one of the trains of each of the skates and a longitudinal axis of the articulated plate of the respective skate is from 12° to 15°.

11. The pair of motorized skates according to claim 1, wherein each of the skates further comprises a single motor configured to drive both the front train and the rear train of the respective skate.

12. The pair of motorized skates according to claim 11, wherein the single motor of each of the skates has an external rotor.

13. The pair of motorized skates according to claim 3, wherein, for each of the skates, an axis of the motor is also a transverse articulation axis of the front train and the rear train of the respective skate.

14. The pair of motorized skates according to claim 1, wherein the front and rear trains of each of the skates are fitted with tracks.

15. The pair of motorized skates according to claim 1, wherein the front and rear trains of each of the skates are fitted with wheels.

16. The pair of motorized skates according to claim 1, wherein, for each of the skates, a transverse articulation axis of the plate has a direction different from that of a transverse articulation axis of the front train relative to the rear train.

17. The pair of motorized skates according to claim 1, wherein, for each of the skates, the rear train is connected to an intermediate portion of the rear portion of the plate.

* * * * *